United States Patent [19]

Tyavlovsky et al.

[11] 4,152,914

[45] May 8, 1979

[54] APPARATUS FOR PRODUCTION OF METAL RIBBON

[75] Inventors: Mikhail D. Tyavlovsky; Semen P. Kundas; Mechislav N. Los; Valentin J. Serenkov; Nikolai V. Vyshinsky, all of Minsk, U.S.S.R.

[73] Assignee: Minsky Radiotekhnichesky Institut, Minsk, U.S.S.R.

[21] Appl. No.: 784,687

[22] Filed: Apr. 5, 1977

[51] Int. Cl.[2] ..... B21J 29/00

[52] U.S. Cl. ..... 72/38; 72/DIG. 20; 72/56; 72/57; 72/700

[58] Field of Search ..... 29/243.54; 72/DIG. 20, 72/DIG. 29, 37, 38, 56, 57, 364, 700; 228/1

[56] References Cited

U.S. PATENT DOCUMENTS

| | | | |
|---|---|---|---|
| 3,209,572 | 10/1965 | Boyd et al. | 72/DIG. 20 |
| 3,495,427 | 2/1970 | Balamuth | 72/DIG. 20 |
| 3,698,219 | 10/1972 | Moore et al. | 72/38 |
| 3,893,318 | 7/1975 | King et al. | 72/38 |

FOREIGN PATENT DOCUMENTS

| | | | |
|---|---|---|---|
| 28379 | 9/1975 | Japan | 72/56 |
| 313593 | 11/1971 | U.S.S.R. | 72/DIG. 29 |
| 499001 | 4/1976 | U.S.S.R. | 72/DIG. 20 |

*Primary Examiner*—E. M. Combs
*Attorney, Agent, or Firm*—Fleit & Jacobson

[57] ABSTRACT

A method according to the present invention comprises the formation of metallic materials by translating metal wire between working tools, that is, a striker and an anvil, which are arranged in a closed space with a medium inert to both the wire metal and material of the tools. The wire is then heated to a temperature high enough for plastic deformation of the metal, while ultrasonic vibrations are simultaneously applied to the working tools, propagating at an angle to the longitudinal axis of the wire. An apparatus for carrying out the proposed method comprises, in addition to the working tools, sources of ultrasonic vibrations which are rigidly coupled to the tools, and a mechanism for heating the working tools and wire.

10 Claims, 20 Drawing Figures

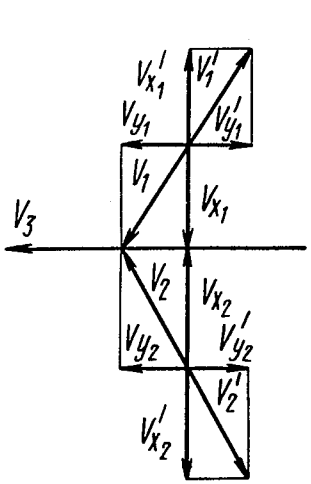
FIG. 10
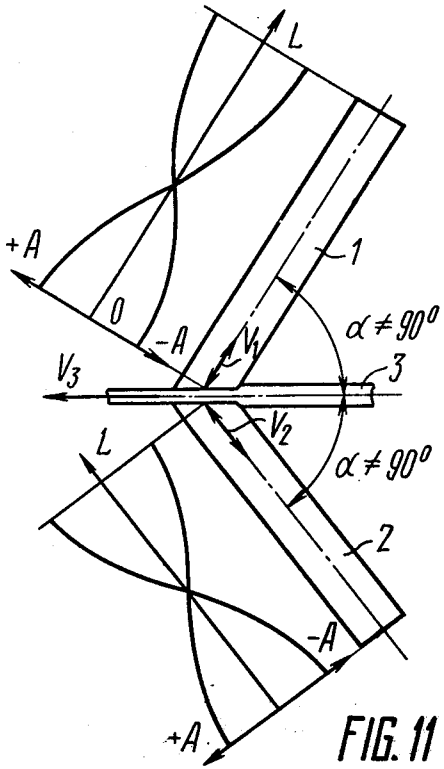
FIG. 11
FIG. 12

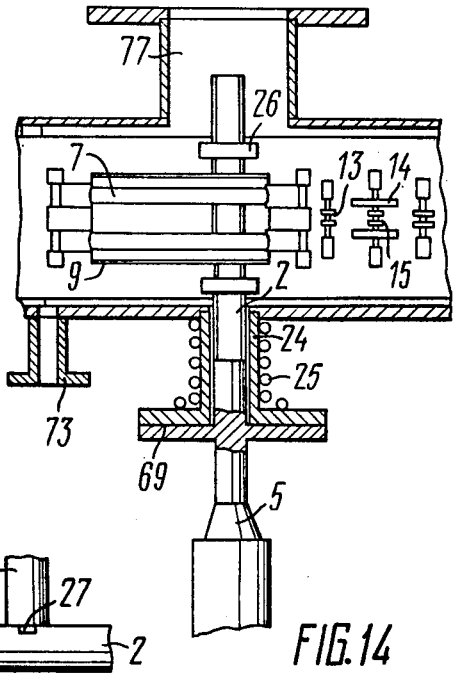
FIG. 14
FIG. 16
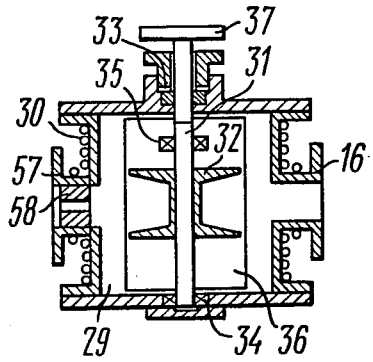
FIG15

APPARATUS FOR PRODUCTION OF METAL RIBBON

The present invention relates to metal working under pressure, and more particularly to a method of producing metal ribbon.

This invention may be found particularly useful for the production of metal ribbon from refractory and readily oxidizable metals and alloys thereof.

Fine metal ribbons and microstrips have been successfully used in the modern instrument-making industry and radio-electronics for various types of current conducting elements or parts of electric vacuum instruments, as springs for clock works and indicator heads, as elements of accelerators, for elastic parts of high-quality oscillographic galvanometers, etc. The above-mentioned parts for various instruments are generally made of refractory metals readily oxidizable at elevated temperatures, and alloys thereof.

It is to be noted that hot-state plastic deformation of refractory and readily oxidizable metals and alloys thereof, in particular that of tungsten and rhenium and alloys based thereon, as well as hot-state plastic deformation of other hard-to-work metals in the atmosphere of air, is inevitably accompanied by their intensive oxidation and gas saturation, which adversely affects physical and mechanical properties of these metals and results in heavy losses of expensive materials. It also necessitates the employment of special operations for the removal of oxidized and gas-saturated layers.

To give an example: during high-temperature forging of molybdenum in air, weight losses in the metal due to oxidation thereof are between 12 and 15%, those of niobium are up to 30%, while high-temperature working of tungsten in air is difficult to effect because of its intensive oxidation.

To effectively carry out high-temperature deformation of refractory and readily oxidizable metals and alloys thereof, and simultaneously decrease or rule out completely their interaction with active gases (oxygen, nitrogen, hydrogen, etc.,), it is necessary to develop new methods of high-temperature working of metals under pressure.

Vacuum and/or an inert gas medium are known to be the most effective protective means for refractory and readily oxidizable metals and alloys thereof, assuming an ever greater application at all stages of metal working, i.e. during heating, deformation and cooling (cf. USSR Inventor's Certificate, N 283162, cl. B21b, 1/38).

However, the quality of the metal ribbon produced under vacuum conditions or in inert gaseous atmospheres is vastly impaired due to intensified metal fusion processes. The metal of the workpiece being worked and the metal of the working tool tend to fuse together, which results in a considerable percentage of defects (formed both on the metal ribbon and on the surface of the working tools are dents, scores and tear-outs of metal).

At the same time, previously known rolling mills used for rolling metal ribbon or strip (cf. USSR Inventor's Certificate N 283162, cl. B21b, 1/38; U.S. Pat. No. 3,096,672, dated July 9, 1963) are quite cumbersome, complicated in operation and inefficient. The aforesaid mills are of the multi-roll type, which makes it difficult to provide a parallel relationship between the working surfaces, or for the rigidity of rolls. The working chambers used therein are also not without flaws. Specifically, the working space thereof is unneccessarily large. This makes it difficult to ensure their tightness and requires highly efficient vacuum means for evacuation of these chambers. When high-strength materials are subjected to rolling in these types of rolling mills, the working rolls thereof rapidly wear out and become unusable.

The above disadvantages may be partially eliminated by substituting the rolling operation with forging of the metal strip. Known in the art is a method of producing metal strip or ribbon by forging, or by spreading the wire, which method comprises passing the wire between two working tools with ultrasonic vibrations being applied to one of the tools perpendicular to the longitudinal axis of the wire (cf. USSR Inventor's Certificate N 313593, cl.B21f, 21/00).

In this method the second working tool, the anvil, remains stationary. Therefore, the forging of wire under vacuum conditions, or at elevated temperatures, will cause intensifying fusion of the metal being worked with the working tool, which in this case remains stationary. Thus, due to the extensive fusion of the wire heated to a high temperature in vacuum, the anvil being stationary, the metal strip forging process will be rendered impossible.

The apparatus used for carrying out the aforesaid method (cf. I.C. N 437328) is provided with two dies adapted for spreading, with one die thereof being secured to the base and the second one to the face end of the ultrasonic vibration source. To pull the ribbon, tension payoff-, and take-up reels are used, said reels being rotatably mounted on the axle of electric motors.

The aforedescribed method has a number of disadvantages. First and foremost, this method does not provide for producing high-quality metal strip or ribbon from readily oxidizable metals. The reason for this is the metal oxidation in air, which is caused by local heating brought about by the process of conversion of the acoustic energy into heat. It is extremely difficult to obtain the metal strip by this method from hard-to-work metals such as tungsten or rhenium, and alloys based thereon, especially by cold working these metals. The working of the aforesaid metals under pressure is possible when these are heated to resolidification temperature. This is to say, metals such as tungsten and rhenium should be heated to a temperature above 1000° C., which, in fact, causes intensive oxidation or burning out in air of the wire made of such metals.

It is an object of the present invention to provide for the production of high-quality metal ribbon or strip from refractory and readily oxidizable metals, and alloys thereof.

It is another object of the invention to provide for higher labour productivity.

It is still another object of the invention to provide a simplified process of producing metal ribbon or strip from refractory and readily oxidizable metals, and alloys thereof.

These and other objects of the invention are accomplished by the provision of a method of producing metal strip or ribbon, comprising the steps of passing the metal wire between an anvil and a striker to which ultrasonic vibrations are applied at an angle to the axis of the wire. The wire and the tools, according to the invention, are placed in a closed space in a medium inert to the wire metal and to the material of the anvil and the striker. The wire is then heated to a temperature causing plastic deformation of the wire metal, while ultrasonic vibrations are simultaneously applied to the anvil and to the striker.

Heating of the wire makes for its higher plasticity.

The fact that ultrasonic vibrations are applied to the second working tool, the anvil, prevents fusion of the latter with the wire being heated under vacuum conditions, and considerably increases the quality and accuracy of the working process. Ultrasonic vibrations may be applied to the working tools both in and out of phase.

The herein proposed method permits reducing expenses and simplifying the process for metal ribbon production from metals and alloys. It also makes for higher productivity of labour, smaller dimensions of the process equipment, lower production cost and reduced working space.

In accordance with a possible embodiment of the invention, ultrasonic vibrations are applied perpendicular to the vibratory motion of the striker and to the direction of the wire feed. Such delivery of ultrasonic vibrations is especially effective in that it provides for high-accuracy and high-quality working of materials having sufficient strength and plasticity.

In another embodiment of the invention, ultrasonic vibrations are applied perpendicular to the vibratory motion of the striker, and parallel to the direction of the wire feed.

Such delivery of ultrasonic vibrations is effective only at a considerably low speed of the wire feed motion in the process of producing metal strip or ribbon from high-strength, hard-to-work metals and alloys.

In certain cases, it is preferable that the direction of ultrasonic vibrations delivered to the anvil should coincide with that applied to the striker.

Such delivery of ultrasonic vibrations to the region of the wire deformation is effective indeed only at high speed of the wire feed motion in the process of producing a metal strip of ribbon from sufficiently high-strength metals and alloys of appreciable plasticity.

Besides, such delivery of ultrasonic vibrations is advantageous when effected at a low speed of wire feed motion in the process of producing metal strip or ribbon from high-strength, low-plasticity metals and alloys.

It is extremely advantageous that torsional vibrations be imparted to the anvil. Such delivery of vibratory energy to the region of wire deformation is effective both at low and high speed wire feed motion, and, therefore, may be successfully employed for producing metal strip or ribbon from high-strength, low-plasticity metals and alloys, as well as from high-plasticity, low-strength metals and alloys.

Where ultrasonic vibrations are applied to the region of the wire deformation with one or two working tools being tilted towards the direction of the wire feed motion at an angle other than 90°, there comes into play horizontal and vertical components of vectors of the vibration velocities. The effort provided by the vertical components provides for the wire forging, while that provided by the horizontal components is used to feed the wire to the region of deformation. This is especially effective when extremely fine ribbons or strips are forged from high-plasticity, low-strength metals, and when metal ribbon or strip is not to be subjected to any significant pulling force.

It is expedient that the wire and the working tools be placed in a closed space under vacuum of not less than $10^{-4}$ mm Hg.

The employment of vacuum makes it possible to completely rule out the interaction of metals, refractory and readily oxidizable metals in particular, which active gases (such as oxygen, nitrogen, hydrogen, etc., ) in the process of working the wire at elevated temperatures.

The fact that inert gas is used as the inert medium makes it possible to substantially decrease the interaction of metals with active gases in the process of working the wire at elevated temperatures.

An apparatus for performing the previously discussed method has an anvil and a striker as working tools, the striker being rigidly coupled to a source of ultrasonic vibrations, payoff-, and take-up power reels disposed on both sides of the working tools, and a tension ribbon control mechanism. The apparatus also has according to the invention, an additional source of ultrasonic vibrations having the anvil rigidly coupled thereto, said anvil being made so as to provide for the formation of a standing wave for a given frequency of the additional ultrasonic vibration source. There is also provided a sealed working chamber having mounted therein said working tools and means for heating the working tools and the wire.

It is expedient that the frequency of oscillations of the ultrasonic vibration source, coupled to the anvil, should exceed the frequency of oscillations of that coupled to the striker.

The use of the herein proposed apparatus makes possible the substitution of rolling and spreading processes effected by rolling mills under vacuum conditions with the process of ultrasonic spreading carried out in vacuum, which completely rules out the setting of metal with working tools. This enables achievement of substantial improvements in quality and accuracy of working the metal ribbon or strip. The coefficient of friction between the ribbon and the working tools sharply decreases with the resulting decrease of the pulling force, which in turn prevents the rupture of ribbon or strip. The higher plasticity of the material being worked, brought about by heating the ribbon and by applying ultrasonic vibrations to the working tools, results in a higher degree of ribbon reduction, as well as in higher quality of the ribbon structure. From the foregoing, it is apparent that the apparatus of the present invention makes it possible to produce metal ribbon or strip with a high degree of reduction thereof in one operating cycle with various metals and alloys being worked upon, including readily oxidizable metals and those which are not easily distortable (tungsten and alloys thereof rhenium, niobium, etc., )

According to one embodiment of the invention, the payoff- and take-up reels, as well as the tension ribbon control mechanism, are mounted within said sealed chamber.

Where the apparatus means are mounted within one sealed chamber, inert gas should be used as a non-oxidizable or neutral medium. This being the case, the tightness of the chamber does not assume as great an importance, and powerful means for the chamber evacuation are not called for.

It is highly preferable that additional sealed chambers be provided with payoff-, and take-up reels, as well as pipes being mounted therein, said pipes communicating said additional chambers with the working chamber.

The additional sealed chambers permit locating payoff- and take-up reels outside the working chamber, which results in reducing the size of the working space. This also improves the quality of the produced ribbon and prevents its oxidation.

Insofar as the latter above-mentioned embodiment of the invention is concerned, it is advantageous that it should be provided with cut-off valves to be fitted in the pipes communicating the sealed working chamber with additional chambers, and which serve to cut off said pipes.

The aforesaid valves enable high vacuum to be maintained in the working chamber during recharging of reels. This enhances efficiency of the means used for evacuating the chamber, making the apparatus simple in operation.

It is expedient that the anvil length be multiple to a half the wavelength transmitted by the additional ultrasonic vibration source.

The above-mentioned and other features and objects of this invention and the manner of attaining them will become more apparent and the invention itself will be best understood by reference to the following description of embodiments of the invention taken in conjunction with the accompanying drawings, wherein:

FIGS. 1,3,5,7,9,11 illustrate versions of the ultrasonic vibration delivery to the working tools, and show diagrams of changes in the oscillation amplitude along the length of the working tools;

FIGS. 2,4,6,8,10,12 are vector diagrams of the vibration velocities of the working tools, and of the speed of the wire feed motion;

FIG. 14 is a plan view of a high-vacuum working chamber;

FIG. 15 is a plan view of a receiving pre-vacuum chamber;

FIG. 16 shows a striker and an anvil fitted with a shaping groove;

Figure 1:
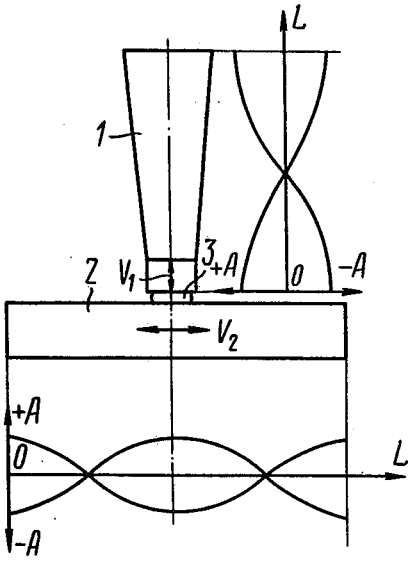

Referring now to FIG. 1, there is illustrated a circuit for ultrasonic vibration delivery to a striker 1 and to an anvil 2, said vibrations being applied to the striker 1 in a direction perpendicular to the axis of wire 3, and to the anvil 2 these are applied in a direction perpendicular to the vibratory motion of the striker 1, and in a direction perpendicular to the feed motion of the wire 3. There is also shown in the same FIG. 1 a diagram of changes in the amplitude A of oscillations along the length L of the working tools 1 and 2.

Figure 2:
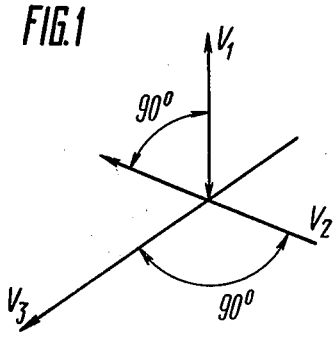

In this case, the stiker 1 and the anvil 2 are arranged in two planes perpendicular to each other. As can be seen in FIG. 2, the striker 1 performs reciprocating motion normal to the plane of the anvil 2 along which the wire 3 passes. In its turn, the anvil 2 performs microvibrations, vector $V_2$ of which lies in the same plane with vector $V_3$ of the wire feed motion and is perpendicular thereto.

Since the vibrating anvil 2 continuously changes its instanteneous position in relation to the wire 3, the fusion of the wire 3 with the anvil 2 is ruled out completely.

The above-stated circuit is most effective when applied in the process of producing fine metal ribbons where enhanced accuracy and surface finish are required.

FIG. 2 illustrates a vector diagram of vibration velocities $V_1$ and $V_2$ of the tools 1 and 2, and velocity $V_3$ of the feed motion of the wire 3.

As can be seen from FIG. 2, vector $V_2$ of the vibration velocity of the anvil 2 lies perpendicular to vector $V_1$ of the vibration velocity of the striker 1, and to vector $V_3$ of the feed motion of the wire 3.

As can be seen from the diagram shown in FIG. 2, the striker 1, performing ultrasonic vibrations directed along vector $V_1$, forges the wire 3. Ultrasonic vibrations of the anvil 2, directed along vector $V_2$, prevent fusion of the wire 3 with the anvil 2.

Ultrasonic vibrations may also be applied to the anvil 2 in a direction perpendicular to the vibratory motion of the striker 1, and in a direction parallel to the feed motion of the wire 3. This is preferred when the striker 1 and the anvil 2 are arranged in two planes perpendicular to each other.

Such a circuit of ultrasonic vibrations will be most effective when the speeds of the feed motion of the wire are relatively low.

Figure 3:
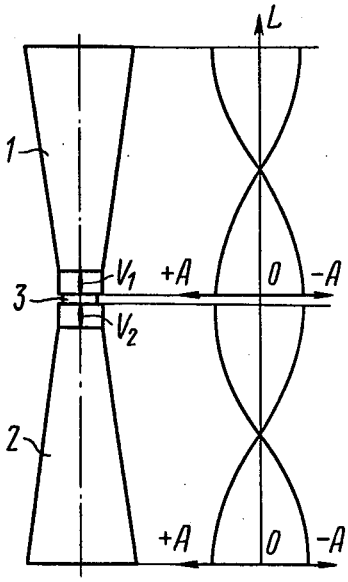

FIG. 3 illustrates a circuit for delivering ultrasonic vibrations to the anvil 2 in a direction coincident with that of the vibratory motion of the striker 1. The striker 1 and the anvil 2 are arranged coaxially in one plane and are capable of vibrating both in phase and out of phase.

With reference to FIG. 3, there is illustrated a vector diagram of vibration velocities $V_1$ of the striker 1 and $V_2$ of the anvil 2, and the velocity $V_3$ of the feed motion of the wire 3 for the circuit shown in FIG. 3.

Figure 4:
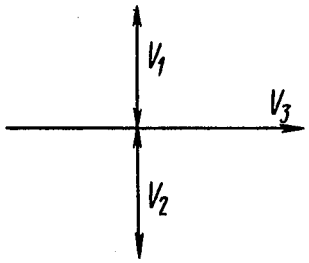

As can be seen in the diagram shown in FIG. 4, the contact between the anvil 2 and the wire 3 will be intermittent. In view of the negligible time of contact between the surface of the anvil 2 and that of the resultant ribbon, fusion thereof will not take place.

The circuit for delivering ultrasonic vibrations shown in FIG. 3, is most effective at high speeds of the feed motion of the wire 3, and, it is to be noted that the higher the speed of the wire 3, the higher is the effect of ultrasonic vibrations.

Figure 5:
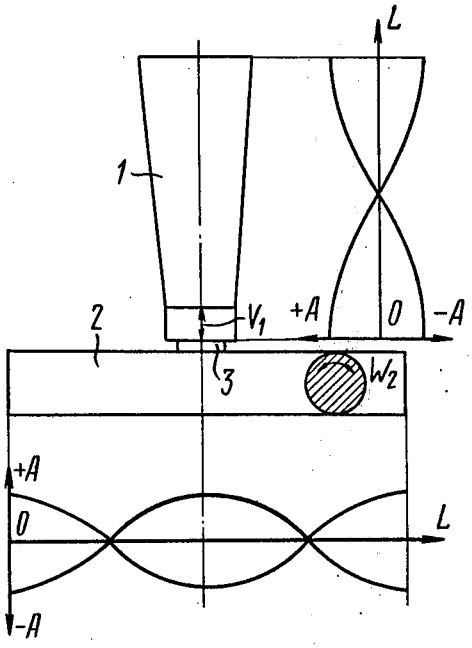

FIG. 5 shows a circuit for delivering ultrasonic vibrations, with the striker 1 and the anvil 2 being arranged in two planes perpendicular to each other.

In this case, the striker 1 performs reciprocating motion normal to the cylindrical working surface generatrix of the anvil 2, along which passes the wire 3 being worked. At the same time a cylindrical anvil 2 performs torsional vibrations $\omega_2$ in a plane perpendicular to the axis of the anvil 2.

Figure 6:
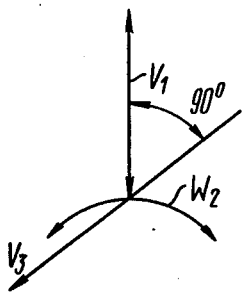

FIG. 6 illustrates a vector diagram of vibration velocities $V_1$, $\omega_2$ of the striker 1 and the anvil 2, and of speed $V_3$ of the feed motion of the wire 3 for the circuit shown in FIG. 5.

As can be seen from the diagram in FIG. 6, torsional vibrations prevent fusion of the wire 3 with the anvil 2.

The delivery of torsional vibrations $\omega_2$ in accordance with the delivery circuit shown in FIG. 5, is effective both at low and high speeds of the feed motion of the wire 3.

Figure 7:
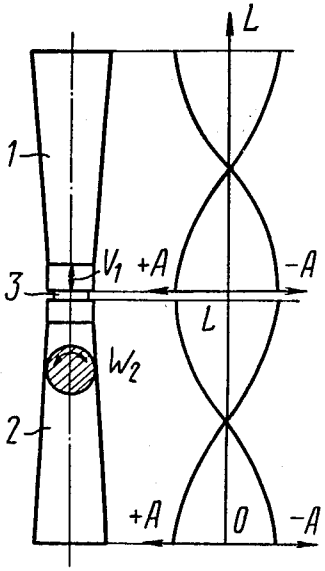

FIG. 7 illustrates a circuit for ultrasonic vibrations when the striker 1 and the anvil 2 are arranged coaxially in one plane. In this case, the striker 1 performs reciprocating motion in a direction perpendicular to the axis of the wire 3. At the same time, the anvil 2 performs torsional vibrations $\omega_2$ in a plane perpendicular to the direction of the vibrating motion of the striker 1.

Figure 8:
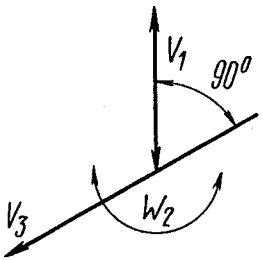

FIG. 8 illustrates a vector diagram of vibration velocities $V_1$ and $\omega_2$ of the striker 1 and the anvil 2 respectively, as well as the speed $V_3$ of the feed motion of the wire 3.

Introduction of ultrasonic torsional vibrations in this case also prevents fusion of the anvil 2 with the wire 3. The aforesaid delivery circuit has been found effective at high speeds of the feed motion of the wire 3.

Figure 9:
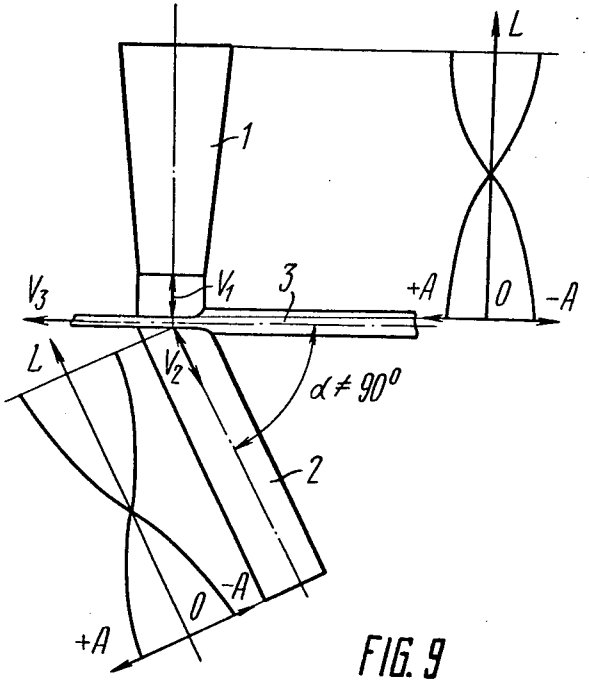

FIG. 9 illustrates a circuit for delivering ultrasonic vibrations, when at least one of the working tools 1 or 2, for example, the anvil 2, is inclined to the direction of the feed motion of the wire 3 at an angle other than 90°.

FIG. 10 illustrates a vector diagram of vibration velocities $V_1$ and $V_2$ of the striker 1 and the anvil 2 respectively, as well as speed $V_3$ of the feed motion of the wire 3.

As can be seen in the diagram in FIG. 10, the vector of vibrating velocity $V_2$ resolves into two components $V_{x2}$ and $V_{y2}$. During the first half-period of vibration of the anvil 2, the efforts characterizied by vectors $V_{x2}$ and $V_1$, provide for the plastic deformation or forging of the wire 3, while the effort characterized by vector $V_{y2}$, enables the wire 3 to be fed to the region of its deformation. During the second half-period of vibration of the anvil 2, the effort characterized by vector $V_{x2}$, prevents fusion of the wire 3 with the anvil 2. Therefore, with a circuit for delivering ultrasonic vibrations such that one of the working tools is inclined to the direction of the feed motion of the wire 3, an effort originates, characterized by vector $V_{y2}$, which tends to urge the wire 3 to the region of its deformation, that is, the vector contributes to feeding of the wire. Moreover, there also originates an effort, characterized by vector $V_{x3}$, which together with the effort characterized by vector $V_1$, effects plastic deformation of the wire 3, that is contibutes to forging thereof.

A version of effecting forging of the metal strip or ribbon, shown in FIGS. 9 and 10, is effective when ribbon is produced from metals of enhanced plasticity, and when excessive pulling efforts at the wire 3 may cause an undesirable deformation thereof.

FIG. 11 illustrates a circuit for delivering ultrasonic vibrations, when both the working tools (the striker 1 and the anvil 2) are inclined to the direction of the feed motion of the wire 3 at an angle other than 90°. FIG. 12 shows a diagram displaying the disposiotin of vectors of vibration velocities $V_1$ and $V_2$ of the striker 1 and the anvil 2 respectively, and of speed $V_3$ of the feed motion of the wire 3 for the circuit for delivering ultrasonic vibrations shown in FIG. 11.

In the diagram presented in FIG. 12, resolution of vectors of vibration velocities $V_1$ and $V_2$ into components $V_{x1}$; $V_{x1}^1$; $V_{y1}$; $V_{y1}^1$; $V_{x2}$; $V_{x2}^1$; $V_{y2}$; $V_{y2}^1$ is also shown.

During the first half-period of the in-phase vibrations, the efforts characterized by components $V_{y1}$ and $V_{y2}$, provide for the feed motion of the wire 3 to the region of deformation, while the efforts characterized by components $V_{x1}$ and $V_{x2}$, provide for forging of the wire 3.

During the second half-period, the efforts characterized by components $V_{x1}$ and $V_{x2}$, prevent fusion of the wire 3 with the working tools 1 and 2, and the efforts characterized by components $V_1^1$ and $V_2^1$, provide for returning the striker 1 and the anvil 2 to their initial position.

The above-stated circuit for realizing the present method of producing metal strip or ribbon is quite effective and the only suitable one for forging extremely fine microstrips from metals of high plasticity and low strength, especially when microstrips being produced from such metals can not tolerate considerable mechanical efforts acting thereon.

Figure 13:
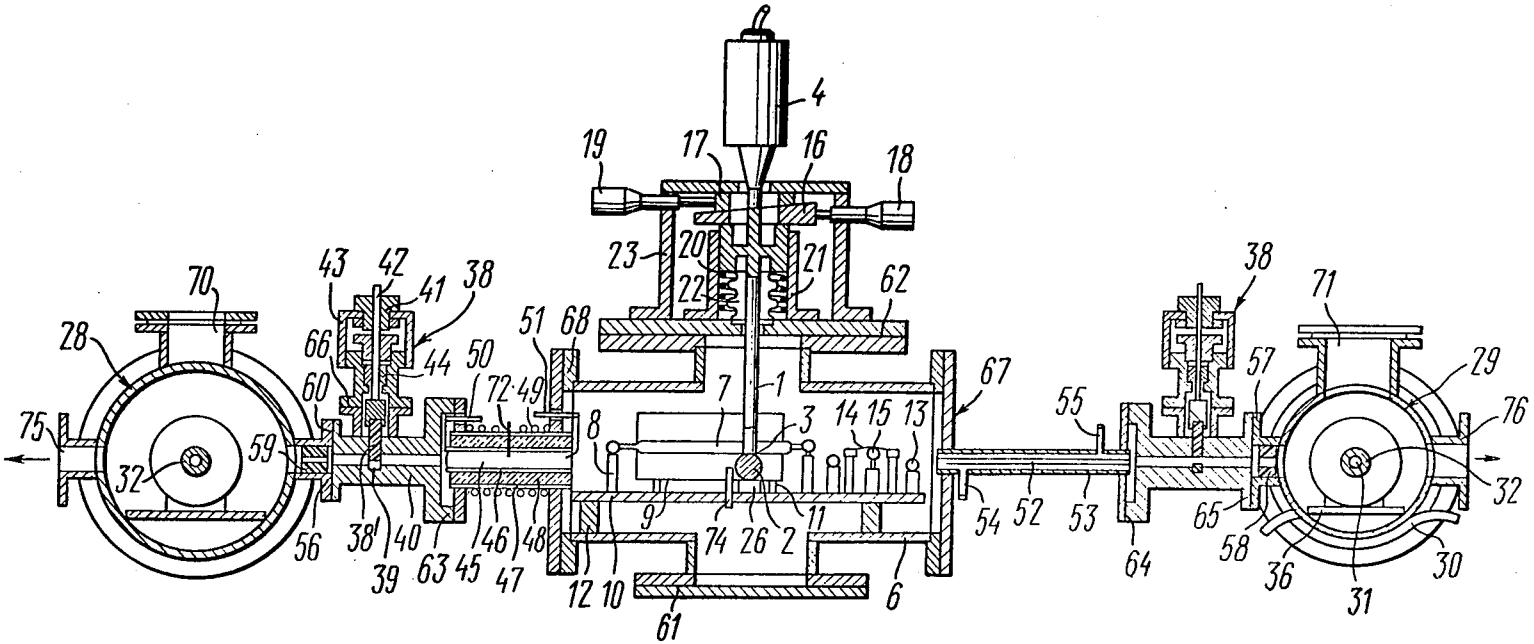
FIG. 13 is an elevation view of an apparatus for realizing the present invention.

FIG. 13 shows an apparatus for carrying out the herein proposed method.

The apparatus of the invention comprises a striker 1 and an anvil 2, adapted to receive wire 3 therebetween. The striker 1 is rigidly coupled to a source of ultrasonic vibrations, which is a magnetostrictive transducer 4, for example, having a resonance frequency f = 22 kHz. The anvil 2 is rigidly coupled to a magnetostrictive transducer 5 (FIG. 14) having a resonance frequency f = 35 kHz.

The length 1 of the anvil 2 is multiple to a half of the wavelength λ of the magnetostrictive transducer 5.

$$1 = n\frac{\lambda}{2} = \frac{n \mp c}{2f}$$

where:

n is an integer 1,2,3 . . .;

f is the frequency of the ultrasonic vibration source;

C is the velocity of propagation of sound in a material from which the anvil is made.

The length of the anvil 2 need not be multiple to a half the wavelength of the ultrasonic source when a special adjusting element (not shown) is used. This element may be made in the form of a rod, rigidly associated with the anvil 2, which is usually produced from a material in which the velocity of propagation of sound differs from that in material of the anvil 2. Acoustic quality factor of the rod material should also differ from that of the material of the anvil 2. The structural arrangement of the anvil 2 with the adjusting element provides for the formation therein of a standing wave for a given frequency of the magnetostrictive transducer 5 which is coupled to the anvil 2. The transducers 4 and 5 are energized from an ultrasonic oscillator with an output power of 400 W (not shown in FIG. 13). The spreading process is effected in a working high-vacuum chamber 6 which accomodates the striker 1, the anvil 2, a means for heating the working tools, consisting of two infrared lamps 7 mounted on supports 8 of an insulating material and energized from a power source with an output voltage control (not shown).

In order to decrease heat losses in the deformation region, the lamps 7, the striker 1 and the anvil 2 are enclosed in molybdenum reflection screen 9 which is secured to a base 10 with the aid of supports 11. The base 10 is mounted within the working chamber 6 on supports 12. Located within the chamber 6 is a ribbon 3 tension control mechanism which incorporates rotating bearings 13 fitted with shaping grooves (not shown) on the external surface thereof, and two strain girders with strain gauges 14 (FIG. 14). The strain gauges 14 are used to follow up the movement of the bearing 15 (FIG. 13) which is movable in a vertical plane, whereby the ribbon tension control is effected. The output signal from the strain gauges 14 is applied to the bridge measuring circuit (not shown).

To set up the clearance between the anvil 2 and the striker 1, a wedge mechanism is used. The mechanism comprises two wedges 16 and 17 which are engaged with a screw 18 of coarse feed and with a screw 19 of fine feed of the striker 1. The striker 1 is spring-biased with the aid of spring 20 which is set up in a cylinder 21 and serves to lift the striker 1 to its original position after the spreading process is over, and to compensate for the atmospheric pressure affecting the striker 1.

Also positioned in the cylinder 21 is a silphon 22 which serves as a sealing packing for the striker 1. The wedge mechanism is affixed on the chamber 6 with the aid of a bracket 23.

The anvil 2 (FIG. 14) is introduced into vacuum space of the chamber 6 through an inlet pipe 24 with a copper water-cooled piping 25 being wound thereon. The cooling of the inlet pipe 24 prevents the fluoroplastic packing (not shown) of the anvil 2 from overheating. To increase the rigidity of the system (the anvil 2 — the striker 1) during spreading of wire, the anvil 2 is mounted on supports 27 (FIG. 16). The shape of groove depends upon the desired profile of ribbon.

The herein described apparatus is also provided with a charging pre-vacuum chamber 29 which is cooled by means of a coil 30 with a coolant therein (FIG. 15). Mounted within the chamber 29 on an axle 31 is a take-up reel 32. The sealing of the axle 31 in the chamber 29 is effected with the aid of a packing 33 (Wilson packing). The axle 31 is mounted in bearings 34 and 35. The bearing 35 is rigidly affixed on a plate 36 which is secured to the walls of the receiving chamber 29.

Rotatary motion is imparted to the reel 32 from an electric motor (not shown) through a clutch 37. The structural arrangement of the charging pre-vacuum chamber 28 is similar to that of the receiving chamber 29 except for the coil 30. In the interspace between the charging chamber 28 and the working high-vacuum chamber 6, there is provided a cut-off valve 38 which actuates fluoroplastic shutters 38' and 39 disposed in an adapter of a pipe 40. The upper shutter 39 is connected with a screw pair 41,42. The screw pair 41,42 is fixed on a bracket 43 which, in turn, is secured to a body (not shown in FIG. 13) of a packing 44 of a movable axle 42 of the screw pair 41–42.

The cut-off valve 38 has coupled thereto a means for heating the wire, this being resistance-type heater 45. The heater 45 is enclosed in a baffle 46 and is inserted into a tube 47. To provide for better heat insulation, the interspace between the tube 47 and the baffle 46 is filled with a heat insulating material 48. Any heat insulating material with low heat conductivity, e.g. powder $Al_2O_3$, may be used for the purpose. The tube 47 is cooled by means of water flowing along the coil 49. The heater 45 is energized by means of water-cooled current leads 50,51.

Connected to the output of the working chamber 6 is a copper tube 52 with a jacket 53. The water is passed through pipe connections 54 and 55. In the interspace between the copper tube 52 and the receiving pre-vacuum chamber 29, there is provided the cut-off valve 38. Openings in the adapter 40, interior passage way of the heater 45, and the copper tube 52 define the passageway along which the wire-ribbon 3 is passed.

Inlet pipes 56,57 of the charging chamber 28 and of the receiving chamber 29 have arranged therein guiding sleeves 58 and 59 made of an antifriction material, such as Esteran. Flange joints 60,61,62,63,64,65 and 66 are sealed with rubber packings, and flange joints 67,78 and 69 are sealed with fluoroplastic packings (packings not shown).

Figure 17:
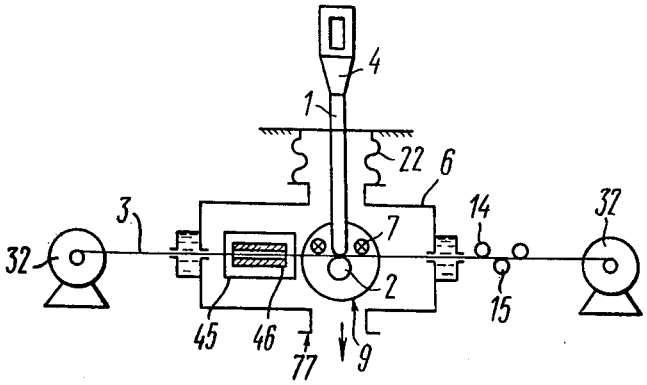
FIG. 17 shows an embodiment of an apparatus wherein tension reels and a ribbon tension control mechanism are arranged outside the sealed chamber.
Figure 18:
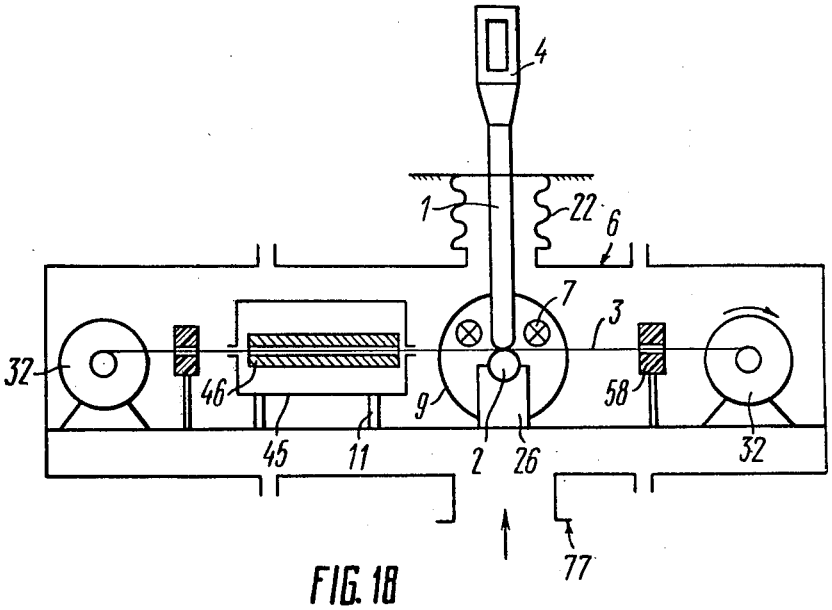
FIG. 18 shows an embodiment of an apparatus wherein inert gas is used as a working medium.

The charging chamber 28 and the receiving chamber 29 are each fitted with viewing ports 70 and 71 respectively. The heating temperature of the wire 3 is controlled by means of platinum-rhodium thermocouple 72 with a signal therefrom being applied to a potentiometer (not shown) with the aid of pyrometer through a pipe 73. The heating temperature of the working tools 1,2 is controlled by means of chromel-alumel thermocouple 74 and a potentiometer (not shown). The evacuation of the vacuum chamber 6,28,29 is effected through pipes 75,76 (FIG. 13) and 77 (FIG. 14) with the aid of mechanical and oil-diffusion pumps (not shown).

Where extremely fine microstrip or ribbon is to be produced by way of cross-section reduction thereof, said strip or ribbon having a low thermal inertia factor, that is it cools down rapidly after heating and reduction to a temperature at which oxidation is non-existent. It is expedient to make use of the alternative of the invention shown in FIG. 17. In this case the sealed chamber 6 of the apparatus has mounted therein only the working tools 1 and 2, the means 7 for heating thereof, and the means 46 for heating the wire 3. The payoff-, and take-up reels 32, as well as the ribbon 3 tension control mechanism are arranged outside the chamber 6. The ribbon or wire 3 is fed into and out of the sealed chamber 6 through special packings (not shown in FIG. 17).

The herein disclosed apparatus is capable of carrying out the cross-section reduction process in the inert gas medium. This being the case, an embodiment of the apparatus shown in FIG. 8 will be preferable. The working chamber 6 of the above-mentioned embodiment accomodates the working tools 1 and 2 the means 7 for heating thereof, the heater 45 for heating the wire, the payoff-, and take-up reels 32, and the ribbon tension control mechanism (not shown). The gas is delivered through the inlet pipe 77. Any inert gas such as argon, may be used as the inert medium.

The disclosed apparatus operates as follows.

Mounted in the charging chamber 28 (FIG. 13) is the payoff reel 32 with the wire 3 wound thereon, and mounted in the receiving chamber 29 is the empty reel 32. With the aid of special pull-through means (not shown) the wire 3 is introduced into the receiving pre-vacuum chamber 29' and is then fixed to the reel 32. The vacuum chambers 6,28,29 are hermetically sealed and afterwards evacuated by means of a pre-vacuum pump to a pressure $1\times10^{-2}$. The degree of evacuation is controlled by an ionization-thermocouple vacuum gauge (not shown in FIG. 1). Thereafter, a valve is opened in a high-vacuum oil-diffusion pumping unit and the working chamber 6 undergoes evacuation procedure until a pressure of $1\times10^{-5}$ is established therein. The infrared lamps 7 are then energized, and the working tools 1,2 are heated to a temperature of about 500° C. Ultrasonic vibrations are next applied to the striker 1 and the anvil 2, and the payoff-, and take-up reels 32 are power-actuated. Pre-tension of the wire 3 is adjusted by alternating the speed of roation of the reels 32. After switching on electric motors the primary heater 45 of the wire 3 is brought into use, and by adjusting the voltage applied to the heaters 45 and 7, and by setting up the stock pulling speed, the requisite heating conditions for the wire 3 are established. The heating temperature of the wire 3 and that of the working tools 1 and 2 is controlled and automatically adjusted by means of potentiometers (not shown). After energizing the heaters 7 and 45, the water is passed along the coils 49, 25, 52, 30. By turning the screw 19 of fine feed, and by establishing a requisite amplitude of ultrasonic vibrations for the striker 1, the desired clearance is obtained between the anvil 2 and the striker 1, i.e., the degree of reduction of the wire 3. If the striker 1 is to be quickly lifted, the screw 18 of coarse feed is turned in the counterclockwise direction. Under the action of the spring 21, the striker 1 is spring-biased in the upward direction.

After the operating conditions for spreading have been set up, the tension control mechanism is switched on. This mechanism is designed to follow up the tension of the ribbon or wire 3, and when there is a departure of the controlled tension from the set degree, said mechanism gives a signal to motors which, by suitably alternating the rotating speed, adjust the tension of the wire or ribbon 3. The unwinding process of reels 32 may be watched through the viewing port 70. The changing of reels 32 in the proposed apparatus is possible without deevacuating the high-vacuum working chamber 6. To this end, the motors actuating the driving mechanism of the reels 32 are shut down. Automatic control system for winding and shutting-down the motors can also be applied. By turning the screw pairs 41,42, the fluoroplastic shutters 38,39 are actuated to cut off the passage openings in adapters 40 with the wire or ribbon 3 being clamped therein. As a result of the aforesaid operations, the high-vacuum working chamber 6 is separated from the pre-vacuum chambers 28,29. With evacuation passages of the pre-vacuum chambers 28,29 being shut-off, said chambers 28,29 are deevacuated and the reels 32 are changed. The wire is pieced together, the chambers 28,29 are evacuated and the valves (not shown) of the pre-vacuum passages are opened. When a requisite pressure value is set, the shut-off valves 38 are opened, and the operating conditions for spreading the wire 3 are set up and the spreading process continues.

The working of wire under vacuum conditions, or in any other medium which rules out the interaction between active gases and the material being worked at elevated temperatures, makes it possible to completely eliminate the oxidation of metals. Vacuum conditions are preferred to inert gas atmospheres, the reason for this being as follows.

The impurity content of inert gas with the purity thereof being 99,995% is twenty thousand times less than that of the atmosphere of air, while under pressure of $10^{-6}$mm Hg. this content is 760 million times as less. In other words, a highly purified inert gas contains other gaseous impurities 38 thousand times as much as those in vacuum of $10^{-6}$ mm Hg.

Figure 19:
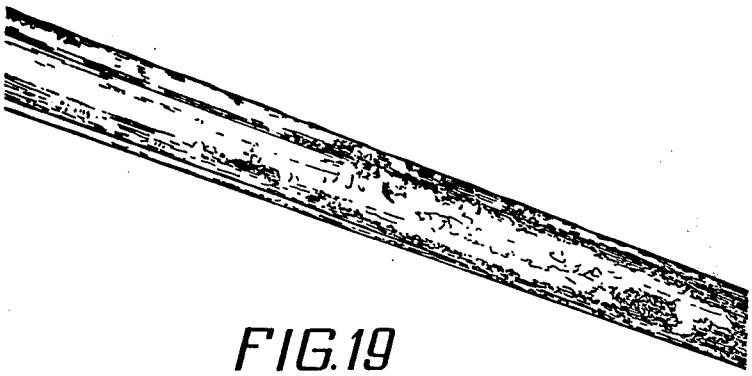
FIGS. 19,20 are photomicrographs of the initial surface of the wire and the surface of the resultant ribbon.
Figure 20:
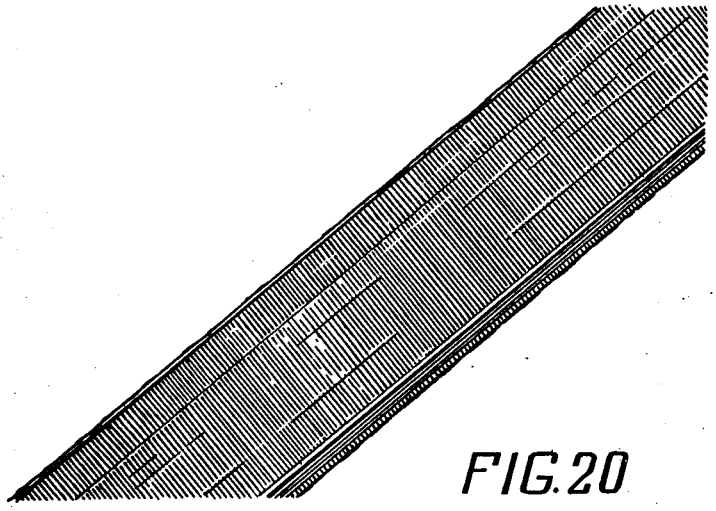

The herein disclosed method and apparatus for the production of metal ribbon or strip has a number of advantages over the prior-art methods and apparatus, namely: metal ribbon or strip can be produced from any metals and alloys, including those which are hard to work, readily oxidizable or refractory, the resultant ribbon or microstrip featuring high-quality structure, high accuracy and high degree of surface finish, which is obvious from the photomicrographs of the original surface of the wire to be worked (FIG. 19) and the surface of the resultant strip (FIG. 20). As may be seen at the photomicrograph, enlarged by 760 times, shown in FIG. 19, the wire surface has many tear-outs, scores, dents, and other such like defects.

The photomicrograph, enlarged by 500 times, shown in FIG. 20, displays the surface of the resultant ribbon with no such defects thereupon except for minor defects in surface polish, which depend on the state of the working tools 1,2. The aforesaid surface of the metal strip or ribbon withstands all kinds of outside influences, viz., it resists corrosion and oxidation caused by chemical reagents, and opposes mechanical forces causing fatigue and destruction of the metal strip or ribbon. Cutting-off the high-vacuum chamber from pre-vacuum chambers at the time of recharging the reels, results in higher evacuation efficiency and simpler operation of the apparatus.

What is claimed is:

1. An apparatus for the production of metal ribbon from wire, comprising a working chamber adapted to be sealed and evacuated to form a vacuum chamber; an anvil and a striker forming working tools mounted for axial vibration within said chamber, the axial direction of vibration of the anvil being skew to the axial direction of vibration of the striker; sources of ultrasonic vibrations coupled to said working tools, said anvil being constructed in such manner that a standing wave mode is formed therein for a given frequency of said ultrasonic vibration source coupled to said anvil; pay-off, and take-up power reels for wire and for metal ribbon being produced from the wire, said reels being arranged on both sides of said working tools; a means for heating said working tools and wire, said means being arranged within said chamber; and a ribbon tension control mechanism arranged between said reels.

2. An apparatus as claimed in claim 1, wherein said pay-off, and take-up reels and said ribbon tension control mechanism are mounted within said working chamber.

3. An apparatus as claimed in claim 1, further comprising a charging chamber connected to said working chamber and adapted to be sealed; a receiving chamber connected to said working chamber, the pay-off and take-up reels being arranged in the charging and receiving chambers, respectively; and pipe means for communicating the charging and receiving chambers with the working chamber.

4. An apparatus as claimed in claim 3, wherein said pipe means includes pipes for establishing communication between the working chamber and the charging and receiving chambers, and shut-off valves arranged in said pipes and adapted for shutting off said pipes.

5. An apparatus as claimed in claim 1, wherein the length of the anvil is a multiple of a half the wavelength of its source of ultrasonic vibrations.

6. An apparatus as claimed in claim 1, wherein one of the working tools is inclined at an angle to the direction of feed of the wire.

7. An apparatus as claimed in claim 1, wherein both of the working tools are inclined at angles, other than 90°, to the direction of feed of the wire.

8. An apparatus as claimed in claim 1, wherein the length of the anvil is equal to half the wavelength of the additional source of ultrasonic vibrations.

9. An apparatus for the production of metal ribbon from wire, comprising a working chamber adapted to be sealed and evacuated to form a vacuum chamber; an anvil and a striker forming working tools mounted within said chamber; sources of ultrasonic vibrations coupled to said working tools, said anvil being constructed in such manner that a standing wave mode is formed therein for a given frequency of said ultrasonic vibration source coupled to said anvil; the anvil and striker being positioned in mutually perpendicular planes, and the source of ultrasonic vibrations coupled with the striker being coupled in such manner that the striker vibrates in a direction perpendicular to the axis of the wire, and the source of ultrasonic vibrations coupled with the anvil being coupled in such manner that the anvil vibrates in a direction perpendicular to the direction of vibration of the striker; pay-off, and take-up power reels for wire and for metal ribbon being produced from the wire, said reels being arranged on both sides of said working tools; a means for heating said working tools and wire, said means being arranged within said chamber; and a ribbon tension control mechanism arranged between said reels.

10. An apparatus for the production of metal ribbon from wire, comprising a working chamber adapted to be sealed and evacuated to form a vacuum chamber; an anvil and a striker forming working tools mounted within said chamber; sources of ultrasonic vibrations coupled to said working tools, said anvil being constructed in such manner that a standing wave mode is formed therein for a given frequency of said ultrasonic vibration source coupled to said anvil, the anvil having a cylindrical working surface, and the source of ultrasonic vibrations coupled with the anvil being coupled is such manner that the anvil performs torsional vibrations, and the source of ultrasonic vibrations coupled with the striker being coupled in such manner that the striker vibrates in a direction perpendicular to the cylindrical working surface of the anvil; pay-off, and take-up power reels for wire and for metal ribbon being produced from the wire, said reels being arranged on both sides of said working tools; a means for heating said working tools and wire, said means being arranged within said chamber; and a ribbon tension control mechanism arranged between said reels.

* * * * *